United States Patent [19]

Thomas et al.

[11] 4,389,443

[45] Jun. 21, 1983

[54] CUT PILE FABRIC WITH FUSED CARRIER AND METHOD OF MAKING SAME

[75] Inventors: Reese R. Thomas, Libertyville; John W. Ellicson, McHenry; Ronald Somerville, Gurnee, all of Ill.

[73] Assignee: Ozite Corporation, Libertyville, Ill.

[21] Appl. No.: 329,649

[22] Filed: Dec. 10, 1981

Related U.S. Application Data

[63] Continuation of Ser. No. 159,473, Jun. 16, 1980, abandoned.

[51] Int. Cl.[3] ..... B32B 3/02; B32B 33/00

[52] U.S. Cl. ..... 428/92; 156/72; 428/93; 428/94; 428/95; 428/97

[58] Field of Search ..... 428/85, 92, 93, 94, 428/95, 97; 156/72

[56] References Cited

U.S. PATENT DOCUMENTS 3,152,381 10/1964 Priester ..... 428/91

3,867,243 2/1975 Stoller ..... 428/85

*Primary Examiner*—Marion McCamish

*Attorney, Agent, or Firm*—Wood, Dalton, Phillips, Mason & Rowe

[57] ABSTRACT

A novel cut pile fabric (210) and a method of making same is disclosed. The cut pile fabric (210) includes a needled non-woven batt (14) of staple fibers (12) that has an integral carrier member (74) formed by fusing a face surface (22) of the needled batt. A texturized surface is formed on the batt (14) using a texturized needle loom (17) which punches through the batt (14) from the one surface (20) (called the back surface) of the batt so that texturized loops (76) project from the carrier member (74). The non-texturized back surface (20) of the batt (14) has a backing (24) applied as by latexing, fusing, or the like, with the texturized loops (76) being tigered by a tigering roll (28) to break, fracture or cut a high percentage of the loops (76). The tigered pile is polished by a polishing roll (34) to remove the crimps in the fibers and to orient the fibers in a direction transverse to the plane of the batt (14) prior to being sheared in a shear (36). A denser, plusher, lighter weight cut pile fabric is produced having increased stability and strength.

7 Claims, 15 Drawing Figures

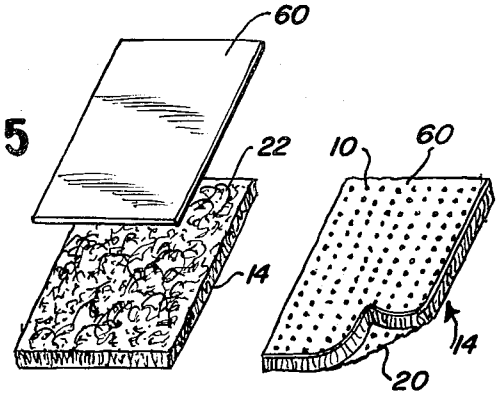
FIG. 5
FIG. 6
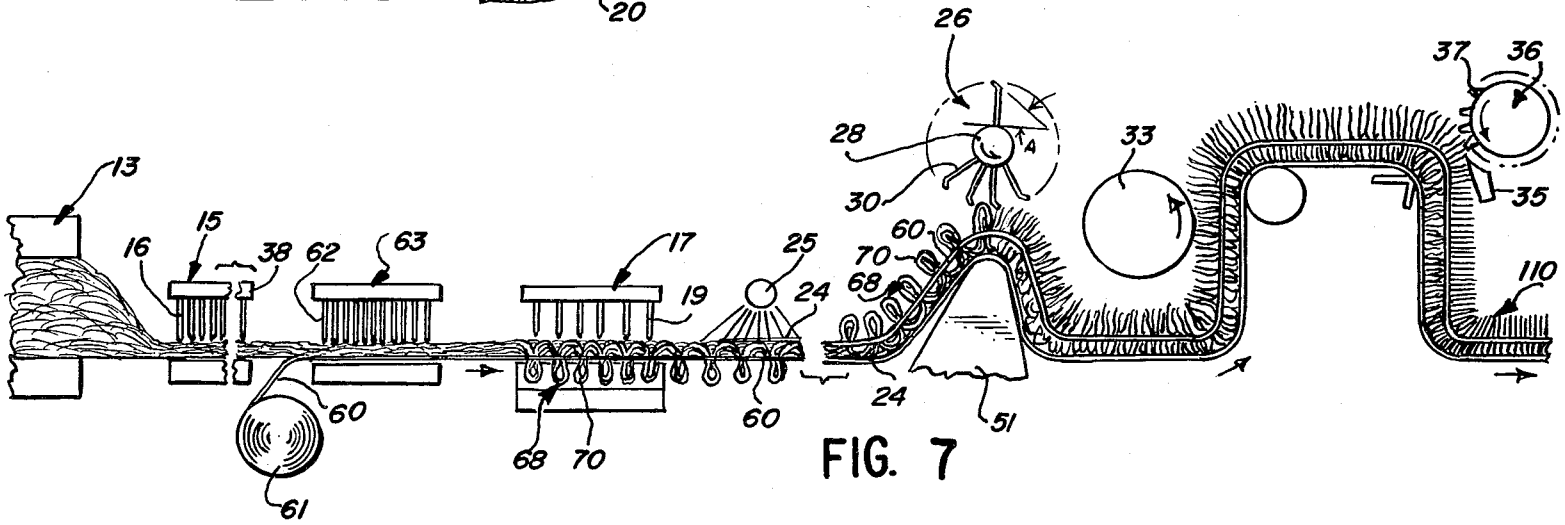
FIG. 7

CUT PILE FABRIC WITH FUSED CARRIER AND METHOD OF MAKING SAME

This is a continuation of application Ser. No. 159,473, filed June 16, 1980, now abandoned.

DESCRIPTION

1. Technical Field

This invention relates to a cut pile fabric and a method of making same and, more particularly, to a cut pile fabric made from a needled batt of non-woven staple fibers.

2. Background Art

There have been on the market for many years fabrics having a backing member, such as jute or burlap, or the like, which may or may not have a non-woven batt of staple fibers secured thereto as by the use of adhesive, needle bonding, fusion, or the like. Yarn is tufted through the backing and/or through the batt. The ends of the tufts are then napped, tigered, or cut to produce a fleece-like material, see U.S. Pat. No. 3,152,381 issued Oct. 13, 1964 to Priester et al and U.S. Pat. No. 2,913,803 issued Nov. 24, 1959 to Dodds, or a frieze effect material, see U.S. Pat. No. 3,341,386 issued Sept. 12, 1967 to White et al. all of this prior art has in common the use of tufting to provide looped pile, the loops of which are then napped or cut to produce the fabric having a deep, soft surface thereon.

U.S. Pat. No. 3,674,618 issued July 4, 1972 to Spann discloses a process for making an imitation silver knit pile fabric wherein a thin thermoplastic film is placed on a non-woven layer of staple fibers. The fibers are needled through the film and the film is thermally bonded to the fibers. The layer of fibers are then napped, sheared and polished to produce an apparel fabric that is soft and pliable.

U.S. Pat. No. 3,347,736 issued Oct. 17, 1967 to Sissons shows attaching a reinforcing member to a surface of a web of staple fibers. The web and reinforcing member are needle punched from the side of the web opposite the reinforcing member to force fibers through the reinforcing member to form fiber tufts. The resulting product is immersed in boiling water to crimp the fibers.

The present invention is directed to overcoming one or more of the problems inherent in the structures of the above fabrics.

DISCLOSURE OF INVENTION

A cut pile fabric and method of making same are provided that overcomes the problems and disadvantages of the prior art while producing an improved relatively deep and dense plush cut pile. The fabric is formed from a needled batt of non-woven staple fibers that is texturized through the batt from one surface to produce closely spaced loops of fibers from the other surface thereof. The batt is then backed by applying to said one surface a coating of latex, by fusing said one surface, or the like, to fix the fibers in the batt and in the spaced loops prior to tigering the loops. The tigering of the loops cuts, breaks or fractures the loops of fiber resulting in a lofted, dense cut pile. The tigered fibers are then polished to raise the fibers of the pile to a vertical orientation, to straighten the crimps in the fibers and to direct the lay of the pile. The polished fibers are sheared to the desired depth of pile resulting in a fabric having a dense cut pile which has strength and stability.

In one modified form of cut pile fabric, a carrier member, such as a sheet of polyethylene, or the like, is carried by the other or face surface of the batt of non-woven fibers. The sheet may be needle punched, heat laminated, or in other ways, attached to said other or face surface of the batt. The batt and carrier member are texturized by needling the non-woven fibers through the batt and through the carrier member from the one or back surface of the batt to produce texturized loops projecting outwardly from the carrier member. After applying a backing, such as latex, or the like, to the one or back surface of the batt to set the non-woven fibers therein, the texturized loops are tigered to break, fracture or cut the loops to form a lofted, dense pile surface. The pile surface is polished and sheared to produce a desirable, even denser pile surface than that resulting from the first above described form of fabric and has strength and stability. A novel sequence of manufacturing steps are performed to produce cut pile fabric having the carrier member integrated therein.

Another modified form of cut pile fabric is provided wherein a batt of non-woven staple fibers is fused on said other or face surface to form an integral carrier member. The batt is texturized through the one or back surface of the batt to form texturized loops projecting outwardly from the fused integral carrier member. The one or back surface of the batt has a backing applied thereto by fusing the one surface, by a coating of latex or the like to set the fibers of the loops after which the loops are tigered to break, fracture or cut the loops to form a lofted, dense pile surface. The pile surface is polished and sheared to produce the desired cut pile fabric which has strength and stability and is of lighter weight. A novel sequence of manufacturing steps are performed to produce the cut pile fabric having the integral carrier member.

BRIEF DESCRIPTION OF THE DRAWINGS

FIGS. 1(*a*) through 1(*f*) illustrate the various stages of manufacture of the improved cut pile fabric resulting in the finished fabric of FIG. 1(*f*);

FIG. 5 is a perspective view of a needled batt of staple non-woven fibers, similar to FIG. 1(*b*), with a carrier member exploded above the surface thereof.

FIG. 6 is a perspective view of the needled batt and carrier member of FIG. 5 needle punched together;

FIG. 7 illustrates a schematic fragmentary manufacturing line for practicing the method of the present invention to perform the various stages of manufacture of a fabric having a carrier member as a part thereof;

BEST MODE FOR CARRYING OUT THE INVENTION

Figures 1A, 1B, 1C, 1D, 1E, 1F, 2, 3, 4:
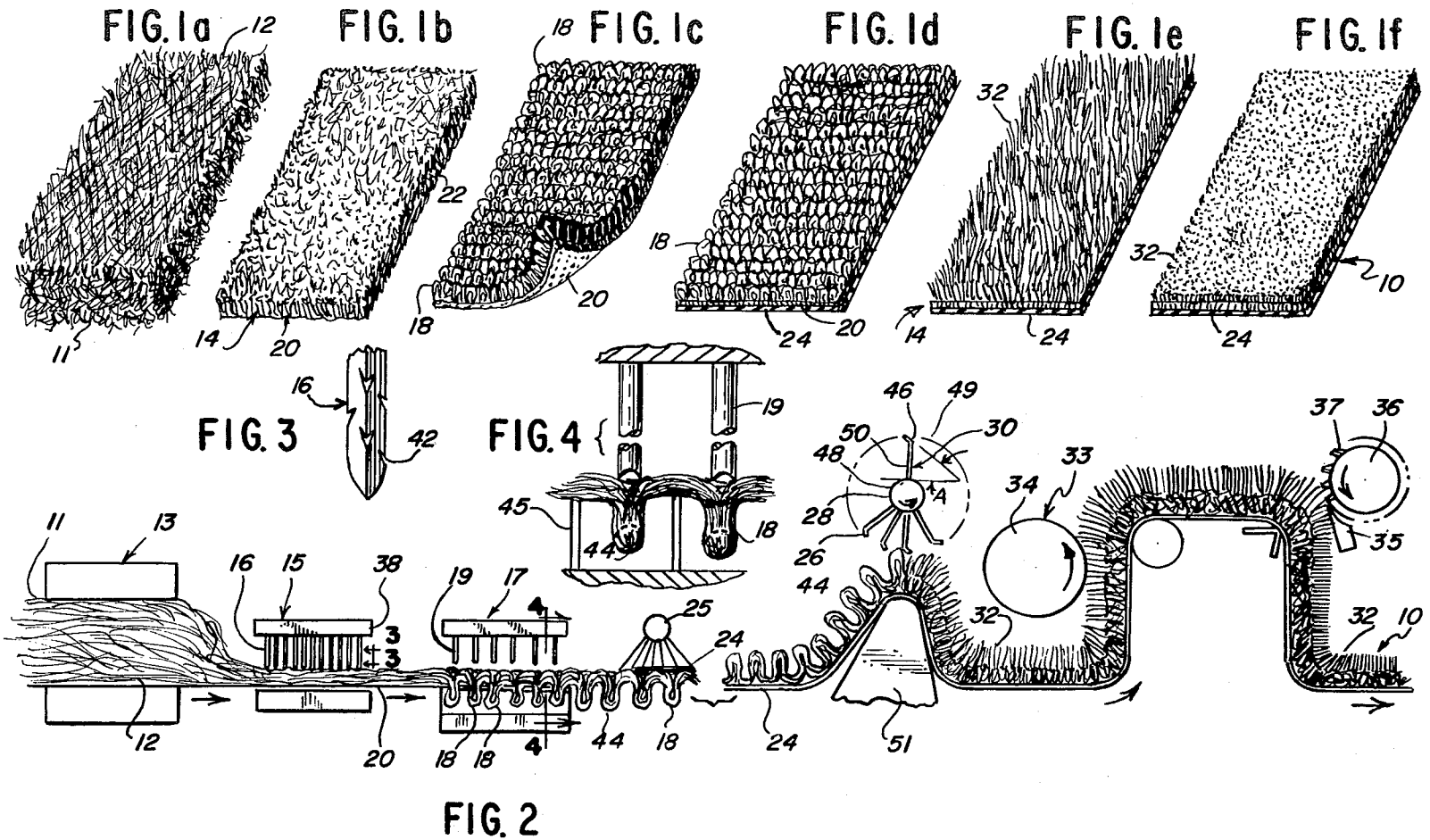
FIG. 2 illustrates a schematic fragmentary manufacturing line for practicing the method of the present invention to perform the various stages of manufacture of the fabric of FIGS. 1(*a*) through 1(*f*)
FIG. 3 is an enlarged view taken along line 3—3 of FIG. 2 of the needle of a needle loom.
FIG. 4 is an enlarged cross-sectional view of two adjacent texturizing needles taken along the line 4—4 of FIG. 2.

FIGS. 1(*a–f*) and 2 illustrate one preferred form of fabric 10 and the method of manufacturing same. Non-woven staple fibers 12 are laid up in a continuous web 11, as in FIG. 1(*a*), using, for instance, a conventional lapper 13, FIG. 2, whereupon as the web 11 is advanced past a needle loom 15, FIG. 2, it is needled into a continuous batt 14, FIG. 1(*b*), using conventional barbed needles 16, one of which is shown in enlarged fashion in FIG. 3. The batt 14 may be needled from both sides or from one side, as shown, depending upon the materials of the fibers and the desired weight of the finished fabric. In a preferred form of the steps of manufacture, and assuming that the batt 14 was needled from one side only, which was from above in FIG. 2, the needled batt 14 is turned over or reversed before it is fed to a texturizing needle loom 17. The turning of the batt 14 may be accomplished by rolling the batt onto a roller (not shown) as it leaves the needle loom 15, after which the roller is reversed and the batt 14 is fed to the texturizing needle loom 17 so that the batt 14 is texturized from the side of the batt opposite to the single needled side. If the batt 14 was needled from both sides, it is fed to the texturizing needle loom 17 oriented so that the texturizing needles penetrate first into the first punched side so that the texturizing loops project from the last-punched side. The batt 14 is advanced past the texturizing needle loom 17 where it is texturized into loops 18. The texturizing needle loom 17 uses fork needles 19 which pass through one surface, such as a back surface 20, of the batt 14 to push fibers caught on the ends of the needles through another surface, such as a face surface 22, to form the texturized loops 18 extending from said face surface 22.

A backing 24, such as a coating of latex or the like, is applied to said back surface 20 using a conventional latex applicator 25, FIG. 1(*d*), to lock the fibers 12 of the batt 14 and, in particular, the fiber ends of the loops 18 that are still in the batt and to add stiffness to the batt. The applicator 25 as shown in FIG. 2 is a commercially available spray applicator which applies the backing 24 as the batt 14 is moved past the applicator with the back surface 20 facing upward. In place of the latex backing 24, when the nature of the material of the fibers in the batt 14 is thermoplastic, or the like, the back surface 20 may have the backing 24 formed by fusing (not shown) using an appropriate heat roll, or the like, which is intended to lock the ends of the fibers forming the loops and to add stiffness to the batt. The backing 24 gives strength and stability, as well as stiffness, to the finished fabric. In general, the latex backing 24 is used for high melt materials such as nylon, acrylic or the like, and fused backing is used with the lower melt materials such as polypropylene or the like.

The texturized and backed batt 14 is then reversed or turned over so that the loops 18 project upward and the backing 24 faces downward. The batt is moved through a tigering apparatus 26 where one or more tigering rolls 28 are rotated, preferably in the direction of movement of the batt 14, i.e. counterclockwise as the batt 14 moves to the right in FIG. 2, wherein a plurality of tigering wires 30 break, fracture or cut the texturized loops 18 to create a lofted, dense pile 32. The rolls 28 may rotate in a clockwise direction, as viewed in FIG. 2, without departing from the spirit of the invention. The batt 14 with the tigered pile is then moved past a polishing apparatus 33 having a polishing roll 34, FIG. 2, which will raise the pile to a more transverse orientation with respect to the batt 14 and will remove the crimps in the fibers adding depth to the pile. A preferred form of polishing apparatus 33 is shown in FIG. 2 with the polishing roll 34 addressing the batt 14 as the batt is moved vertically. The polishing apparatus 33 is mounted on the same frame as a shear 36 with the polishing apparatus 33 and shear 36 being synchronized for simultaneous operation. The polishing apparatus 33 and shear 36 are standard, commercially available pieces of equipment that are incorporated in the line of manufacture of the fabric. The batt 14 with the polished pile 32 is next moved past the shear 36 so that the shear 36 will shear or cut the pile 32 or the raised cut ends of the fibers to a uniform height above the plane of the batt 14.

More specifically, staple fibers 12 of polypropylene, nylon, polyester, or the like, of a length within the range of 2" to 4" and preferably about 3" long having a denier within the range of 6 to 60 and preferably in the range of 6 to 20, are laid up in the lapper 13 to form the web 11 after which they are needled in the needle loom 15 to form the needled batt 14. The batt 14 will generally have a weight within the range of 6 ounces to 30 ounces per square yard. As shown, a single needle board 38 supports an appropriate number of needles 16, one such needle 16 being shown in enlarged form in FIG. 3, which have barbs 42 for needle punching the fibers 12 together into the batt 14. It has been found that the minimum lengths of the fibers should not be below about 2" since shorter lengths reduce fabric strength and the quality of the finished product.

After turning the batt 14, the texturizing needle loom 17, having the fork ended needles 19, as shown enlarged in FIG. 4, texturizes the batt 14 by pushing clusters 44 of loops 18 of fibers 12 from the body of the batt. As shown in FIG. 4, the needles 19 have a fork shape which, in the present setup, have the openings in the fork running parallel to the direction of movement of the batt (the machine direction) so that the openings in the loops will extend across the direction of movement of the batt (the cross machine direction). As shown in FIG. 4 lamellas 45 are aligned in the machine direction and are fixed adjacent to the path of movement of each row of fork needles 19. The lamellas are located on the opposite side of the batt from the needles to provide support for the batt and to provide grooves for the formation of the clusters 44 of loops 18. Each cluster 44 contains plural loops 18 of different sizes due to the catching and pulling of different portions of individual fibers between adjacent side-by-side and front-to-rear clusters. The texturizing needle loom is adjusted to push between 20% to 65% by weight of the fibers 12 from the batt to form the loops, with a more common percent being 35%. The height of the highest loops 18 above the face surface 22 is in the range of $\frac{1}{8}$" to $\frac{3}{4}$". By texturized loops is meant a plurality of clusters of loops of fibers formed from a batt of non-woven staple fibers where each cluster contains a plurality of different sized loops of fibers. The loops of each cluster are formed by a forked needle open in the machine direction so that the loops of each cluster will have openings generally aligned in the cross-machine direction. As will be apparent in FIG. 1(*c*) and in FIG. 2 at loom 17, a plurality of cross-machine or crosswise rows of clusters of loops will be formed simultaneously while forming, as viewed in FIG. 4, which is a view transverse to FIG. 2, a plurality of columns of clusters of loops in the machine direction.

After texturizing, the batt 14 is provided with a backing 24. As illustrated, the backing 24 is a coating of latex applied in a spray applicator 25 after which the coating is dried in a conventional manner. A typical latex material is SBR (Styrene Butadiene Rubber), sold under the tradename DAREX by W. R. Grace Co. As an alternative, backing 24 may be a sintered polyethylene applied in conventional fashion onto the back surface 20 eliminating weight and cost of the latex while still providing fabric strength and moldability. As a second alternative, backing 24 may be a thin thermoplastic sheet laminated to the back surface 20 of the batt 14. The thermoplastic sheet could contribute to mold retention of the fabric, for instance, for a molded carpet for use on the floor of an automobile or truck. As another alternative backing 24, the back surface 20 may be fused to form the backing, assuming, that is, that the materials of the fibers are of a fusible nature. The purpose of the backing 24 is not only to back the fabric, but also to lock the fibers 12 in the batt 14 and, in particular, to lock as many of the ends of the fibers that have been formed into loops 18 as is possible. This affords the anchoring affect for the fibers of the loop 18 so that the tigering apparatus can sever the loops 18 as by breaking, fracturing or cutting. When the finished fabric is to be used in marine applications, the latex backing 24 may not be desirable due to its solvency in gasoline, and the like, and due to its flammability. Therefore, for marine or similar applications, a fused backing, or the like, is preferred.

The tigering apparatus 26 includes one or two tigering rolls 28 (only one being shown) which has a plurality of wires 30, each of which has a short distal contact portion 46 which extends at an angle A within the range of approximately 60° to 90° to a tangent to the cylindrical hub 48 drawn at the intersection of an extension of the portion 46 to said hub 48. The contact portion 46 may extend all the way from the hub 48 or may be connected at a bend or knee 49 to a proximal portion 50 of each wire 30. The tigering roll or rolls 28 rotate at speeds in the range of 500 to 1000 r.p.m. as the texturized batt 14 is advanced at a speed within the range of about 6 feet to 25 feet per minute. The cross-sectional shape of each wire 30 may be round, square, or rectangular and should be of a length to reach into the texturized clusters 44 to engage and break, fracture or cut approximately 90% of the loops 18. In alignment with each tigering roll 28 is a cloth rest 51 which is shaped and located relative to the tigering roll 28 in such a way that the loops 18 of the clusters 44 of the texturized batt 14, in passing over the rest 51, are presented to the wires 30 of the tigering roll 28 in an open exposed condition thereby affording the wires 30 a maximum pass at the loops 18 in the least compacted form of the loops. In this way, the wires 30 effectively break, fracture or cut the maximum number of fibers 12 of the loops 18 without fouling or breaking the wires. The spacing between the tips of the wires 30 and the surface of the rest 51 is adjusted according to the fabric construction. The wires 30 could be straight and angled to a tangent to the hub 48 at an angle within the range of 60° to 90°, however, applying a knee 49 or a curve to the wires 30 reduces vibration and eliminates shock and wire breakage. It is recognized that the ends of a few fibers 12 will not be sufficiently anchored by the other fibers in the needled batt 14 or by the backing 24 so that a few ends will be pulled from the batt 14, however, it is intended that as many as possible of the loops 18 will be broken, fractured or cut as aforesaid.

The tigering roll or rolls 28 will produce a fabric having some long, some intermediate, and some short fibers which will give a lofted, dense, but somewhat uneven, pile 32.

The polishing apparatus 33 will have at least one heated polishing roll 34 which will act on the fractured fibers 12 to remove the crimp in the fibers and to vertically orient the fibers relative to the batt. The polishing apparatus 33 can be any of the commercially available types, such as a heated electrostatic polisher, which is rotated at speeds in the range of 500 to 1000 r.p.m. as the batt 14 is moved past the polisher at a speed within the range of 6 to 25 feet per minute. The temperature of the polisher is determined by the fiber type, polypropylene, for instance, requires a temperature of approximately 215° while polyester requires a temperature of approximately 300°. The polisher addresses the cut fibers of the batt 14 as the batt is moved vertically past the heated roller 34. The polisher will further increase the depth of the pile 32 and will elevate the fibers so that they approach the shear 36 at the most advantageous and most efficient angle. The blades 37 of the shear are rotated in a counterclockwise direction past the shear plate 35 to cut or shear the ends of the fibers. Some fiber weight and height is lost during the shearing step, but this is unavoidable and does not affect the end product. The sheared batt 14 results in a cut pile fabric of exceptionally fine quality that is dense and plush.

EXAMPLE 1

A plurality of layers of non-woven staple fibers of 3" lengths of polypropylene was lapped into a continuous web 11 which was then needle punched from one side at a count of 1100 punches per square inch to form a continuous batt 14. The needle punched batt 14 was then turned over and was texturized from the opposite side on a texturizing needle loom 17 to form texturized clusters 44 of loops 18 with 35% of the fibers 12 of the batt 14 being punched through the face surface 22 to a height of ½". The fork needles 19 used on the texturizing needle loom 17 were 25 guage—2½" length—0.30 mm spacing between points of the fork, which needles were oriented with the opening between the points of the fork disposed parallel to the machine direction. The texturized batt 14 was then moved past spray applicator 25 whereupon a backing 24 of latex, identified as SBR, was applied on the back surface 20 at the rate of 8 ounces per square yard and was dried. The texturized and latexed batt 14 was then turned over and was moved at the rate of 15 feet per minute through a pair of tigering rolls 28 rotating at 780 r.p.m. in a counterclockwise direction to break, fracture or cut the loops 18. The tigering apparatus 26 was made by Polrotor Co. and was a PTM 240/II machine. The rolls 28 had 77 wires per square inch with the wires 30 being equally spaced apart and having a bent configuration presenting a distal portion 46, that extended at an angle of approximately 75° to a tangent to the base of the wire. A polishing apparatus made by Polrotor Co. and identified as a PRS/GF 260D, rotated at a speed of 960 r.p.m. as the batt was moved past the roll 34 of the apparatus at 15 feet per minute. A Polrotor Co. shearing apparatus sheared the fibers to a height of ⅜" resulting in a dense and plush cut pile fabric 10. The fabric 10 may be dyed in conventional fashion or the fibers 12 may have been stock or solution dyed the desired color so that the finished fabric would reflect that color.

Referring to FIGS. 5 through 7, a modified cut pile fabric 110 and the apparatus and the steps for manufacturing same, are illustrated. The lapper 13 and the needle loom 15 for processing of the staple fibers 12 into a non-woven batt 14 is conventional and was discussed with respect to FIG. 2. However, due to the advantageous results flowing from the invention, it is now possible to use staple fibers having lengths within the range of 1" to 4" with one preferred length being approximately 1½". Staple fibers have approximately 100% lengths of 1½" or various blends of staple fibers of different lengths, such as 1½" lengths and 3" lengths, may be used advantageously. The use of the shorter length staple fibers results in a cut pile fabric that is denser and pusher than cut pile fabrics made from longer length fibers.

A carrier member 60 of appropriate material, such as polyethylene, nylon, polyester, or the like, is stored on a roll 61 and is fed to the face surface 22 of the batt 14 and is needle bonded thereto using a second needle loom 63 having a plurality of needles 62 which penetrate from the back surface 20 of the batt 14 for bonding the carrier member 60 to the face surface 22. The carrier member 60 is preferably a continuous sheet of material having a thickness within the range of 4 to 8 mils with a thickness of 6 mils being preferred. It is preferred that the carrier member 60 be applied to the surface of the batt 14 that is opposite to the points of entry of the needles of the last-needle punching operation of the needle loom 15. Other appropriate methods can be employed to tack the carrier member 60 to the batt 14.

The batt 14, with the carrier member 60 attacked thereto, is then oriented so that the back surface 20, remote from the carrier member 60, is facing upward and is presented to the needles 19 of the texturizing needle loom 17 whereupon the batt is moved through the texturizing needle loom 17. The fork tipped needles 19 penetrate from the other or back surface 20 of the batt 14, pass through the batt 14 to pick up and push entrapped fibers from batt 14 and through the carrier member 60 to form clusters 68 of texturizing loops 70 extending outwardly from the carrier member 60. The fork needles 19 push an amount of material equal to between 35% and 80% of the weight of the batt through the carrier member 60. The carrier member 60 provides a structure which strengthens the batt 14 and allows the fibers 12 to be more firmly compacted making it possible to use shorter length fibers in the batt.

The texturized batt 14 with the attached carrier member 60 is then moved past the applicator 25 which is shown as a spray applicator for applying a backing 24 of latex to the back surface 20. The backing 24 is dried to thereby set the fibers and the fiber ends of the texturized loops 70. The backing 24 may also be a sintered polyethylene material applied to the back surface 20 of the batt 14, may be a fused layer of the batt, may be a fused layer of a separate thermoplastic sheet, or the like.

The texturized and backed batt 14 is next passed through a tigering apparatus 26 wherein the tigering roll 28 rotates in the direction of movement of the batt 14 at speeds in the range of 500 to 1000 r.p.m., with 1000 r.p.m. being preferred, to break, fracture, or cut the loops 70 of the texturized surface. The batt 14 with the cut fibers is fed to a polishing apparatus 33 for straightening and orienting the fibers into a substantially transverse direction to the plane of the batt 14 prior to being sheared to a uniform height in a shearing apparatus 36 to provide a dense plush cut pile fabric 110. The carrier member 60 adds strength and stability to the fabric and, in addition, makes it possible to use shorter length staple fibers or blends thereof with improved results. The shorter fibers make it possible to produce a fabric that has a denser pile, plusher cut pile.

EXAMPLE 2

Staple fibers of polypropylene of under 2" lengths were processed on a lapper 13 and a needle loom 15 into a needled batt 14 having 600 punches per square inch and a weight of 20 ounces per square yard. A carrier member 60 of polyethylene of a thickness of 6 mils was applied on the face surface 22 of the batt 14 and was needle bonded thereto using the second needle loom 63. The batt 14 with the carrier member 60 affixed thereto was then texturized on a texturizing needle loom 17 by punching texturized clusters 68 of loops 70 from the batt 14, through the carrier member 60 and extending outwardly from the carrier member. Approximately 70% of the weight of the batt 14 was punched through the carrier member 60 to produce loops 70 with a maximum height of ½". A backing 24 of latex, identified as SBR, manufactured by W. R. Grace Co., was applied on the back surface 20 at the rate of 20 feet per minute and was dried. The texturized and latex backed batt 14 was moved through a tigering apparatus 26 manufactured by Polrotor Co. and identified as a PTM 240/II at the rate of 15 feet per minute as the tigering roll 28 was rotated at 780 r.p.m. The tigered batt was then passed through a polishing apparatus PRS/GF 260D, manufactured by Polrotor Co. at the rate of 15 feet per minute as the polishing roll 34 rotated at 960 r.p.m. A shearing apparatus manufactured by Polrotor Co. sheared the pile ends to a height of ⅜". The resulting cut pile fabric was denser and plusher than the pile of Example 1 and had good stability and strength.

Figure 9:
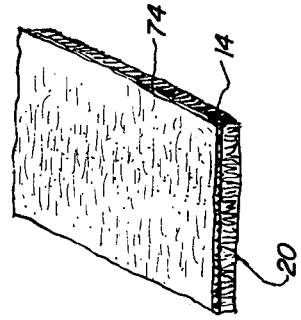
FIG. 9 is a perspective view of the needled batt of FIG. 8 with a carrier member integrally formed therewith.
Figure 8:
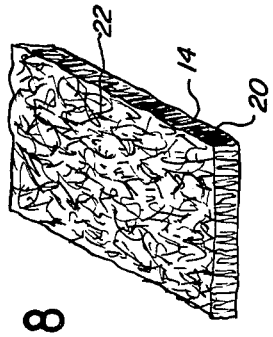
FIG. 8 is a perspective view of a needled batt of staple fibers, similar to FIG. 1(*b*)
Figure 10:
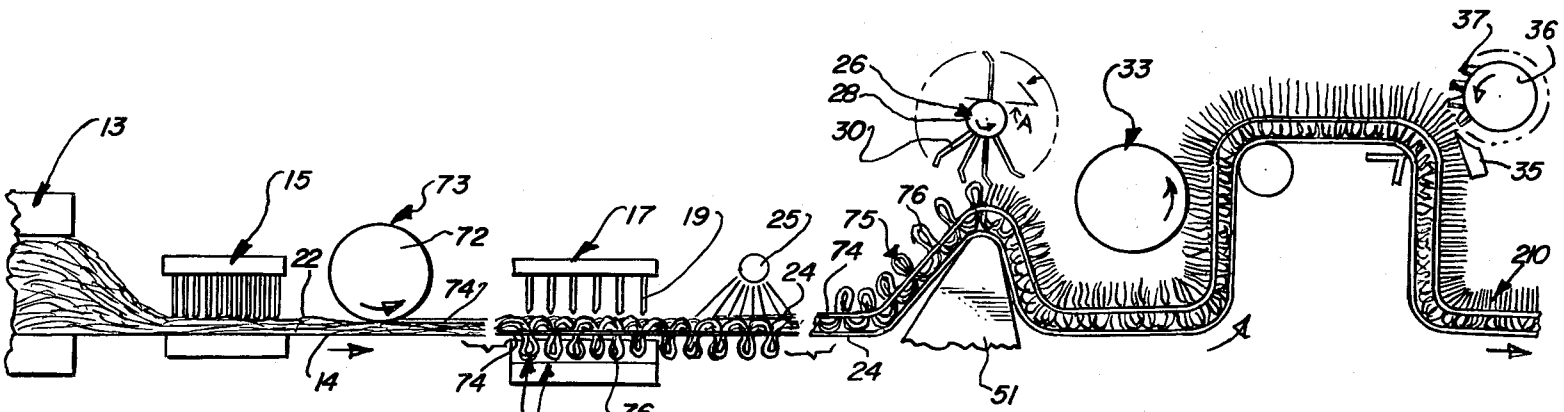
FIG. 10 illustrates a schematic fragmentary manufacturing line for practicing the method of the invention to perform the various stages of manufacture of a fabric having a carrier member as an integral part thereof.

A portion of a second modification is illustrated in FIGS. 8 and 9 with FIG. 10 showing schematically the apparatus for performing the steps of making the modified fabric 210. The lapper 13 and needle loom 15 proess non-woven staple fibers of lengths varying within the range of 1½" to 3" or any combinations thereof into a batt 14. The batt 14 with the face surface 22 oriented toward a fusing roller 72 in a fusing apparatus 73 is moved through the fusing apparatus to fuse the fibers of the face surface area into an integrally formed carrier member 74. The material of the batt must be the type that can be fused by the application of heat. After fusing, the batt is turned, if necessary, to present the carrier member 74 downward, away from the fork needles 19 of the texturizing needle loom 17 and is moved into the texturizing needle loom 17 where the batt is texturized by passing the fork tipped needles 19 through the second or back surface 20 of the batt 14, through the batt 14 and through the fused carrier member 74 so as to form texturized clusters 75 of loops 76. The loops 76 project from the carrier member 74 and include between 30% and 70% by weight of the fibers of the batt 14.

The texturized batt is provided with a backing 24 either by spray applying a coating of latex from an applicator 25, or by applying one of the other backings described hereinabove. The texturized and backed batt 14 is then reversed or turned over and is moved through a tigering apparatus 26 where the wires 30 of a tigering roll 28 break, fracture or cut the loops 76. The batt 14 with the cut loops 76 is then polished in a polisher 33 and is sheared in a shear 36, all as described above. The creating of the carrier member 74 by fusing is less expensive and has less weight than the modification using a separate carrier member. The fused carrier member 74 makes it possible to use shorter staple fiber lengths so that a denser, plusher cut pile is provided which has good strength and stability, is lighter in weight and is less expensive to manufacture.

The carrier members 60 and 74 both can add mold retention characteristics to the cut pile fabric 110,210. That is, for use on automobile floors and truck floors and in related applications, the fabric 110,210 is a carpet and is molded to take the shape of the supporting surface. The carrier member 60 and/or 74 can be molded with the carpet and, if the proper material is used for the carrier member, can retain the molded shape. In addition, the backing materials can also be selected so as to have mold retention capabilities so that a carpet made according to the invention and backed with the proper material, such as a sintered polyethylene, will retain the molded shape.

Other aspects, objects and advantages of this invention can be obtained from a study of the drawings, the disclosure and the appended claims.

We claim:

1. A cut pile fabric comprising:

a needled batt of non-woven staple fibers, a carrier member fused on one surface of said batt from said staple fibers, a plurality of texturized loops of staple fibers pushed from said batt and extending upwardly through the fused carrier member, the texturized loops of fibers comprising a plurality of clusters of loops of staple fibers with each cluster containing a plurality of different sized loops of staple fibers, means formed on the other surface of said batt for backing said batt and for securing the staple fibers of said texturized loops and of said batt to said batt, and a substantial portion of said texturized loops being cut to form cut pile.

2. A cut pile fabric as claimed in claim 1 wherein said cut texturized loops are polished and sheared to provide a plush cut pile fabric.

3. A cut pile fabric as claimed in claim 1 wherein said carrier member is a fused layer of staple fibers forming the face surface of the batt.

4. A cut pile fabric as claimed in claim 1 wherein said staple fibers have lengths within the range of 1" to 4".

5. A cut pile fabric as claimed in claim 1 wherein said staple fibers have a length of approximately 1½".

6. A method of manufacturing a cut pile fabric comprising:

lapping and needling non-woven staple fibers into a batt, fusing the staple fibers on one surface of said batt to form a carrier member on said batt, using a plurality of forked needles to push a plurality of texturized loops of staple fibers from said batt to project outwardly through said fused carrier member, the texturized loops of staple fibers comprising a plurality of clusters of loops of staple fibers with each cluster containing a plurality of different sized loops of staple fibers, applying a backing on the other surface of said batt for adding stiffness to said batt and for securing the staple fibers of said texturized loops and of said batt to said batt, tigering said texturized loops of staple fibers to cut a substantial portion of said texturized loops into cut pile, polishing said cut pile to orient the cut pile in a direction substantially transverse to the carrier member, and shearing said cut pile to a predetermined pile height.

7. A method of manufacturing a cut pile fabric as claimed in claim 6 wherein said fusing of the batt is performed by a heated roll travelling over said one surface to fuse a substantial portion of the fibers of said surface into an integrally formed carrier member.

* * * * *

UNITED STATES PATENT AND TRADEMARK OFFICE

CERTIFICATE OF CORRECTION

PATENT NO. : 4,389,443

DATED : June 21, 1983

INVENTOR(S) : Reese R. Thomas, John W. Ellicson, Ronald Somerville

It is certified that error appears in the above-identified patent and that said Letters Patent are hereby corrected as shown below:

In The Abstract, line 6, delete "texturized" and substitute therefor --texturizing--

Column 1, line 32, delete "silver" and substitute therefor --sliver--

Column 7, line 17, delete "pusher" and substitute therefor --plusher--

Signed and Sealed this

*Twentieth* Day of *September 1983*

[SEAL]

*Attest:*

GERALD J. MOSSINGHOFF

*Attesting Officer*

*Commissioner of Patents and Trademarks*